US010562551B2

(12) United States Patent
Mizuno et al.

(10) Patent No.: US 10,562,551 B2
(45) Date of Patent: Feb. 18, 2020

(54) GROUND APPARATUS AND GROUND APPARATUS SYSTEM FOR TRAIN PLATFORM DOOR OPENING AND CLOSING SYNCHRONIZATION THROUGH GROUND APPARATUS COMMUNICATION NETWORKING

(71) Applicant: KYOSAN ELECTRIC MFG. CO., LTD., Yokohama-shi, Kanagawa (JP)

(72) Inventors: Kenji Mizuno, Sagamihara (JP); Tamotsu Yokoyama, Yokohama (JP); Tomonori Itagaki, Kawasaki (JP); Toshifumi Nishi, Yokohama (JP)

(73) Assignee: KYOSAN ELECTRIC MFG. CO., LTD., Yokohama-shi, Kanagawa (JP)

( * ) Notice: Subject to any disclaimer, the term of this patent is extended or adjusted under 35 U.S.C. 154(b) by 0 days.

(21) Appl. No.: 16/185,149

(22) Filed: Nov. 9, 2018

(65) Prior Publication Data

US 2019/0092357 A1 Mar. 28, 2019

Related U.S. Application Data

(63) Continuation of application No. PCT/JP2016/064110, filed on May 12, 2016.

(51) Int. Cl.
*B61L 3/12* (2006.01)
*B61B 1/02* (2006.01)
(Continued)

(52) U.S. Cl.
CPC ..... *B61L 3/125* (2013.01); *B61B 1/02* (2013.01); *B61L 23/00* (2013.01); *B61L 25/025* (2013.01); *B61L 27/0077* (2013.01)

(58) Field of Classification Search
CPC ... B61B 1/02; B60J 5/062; E05F 15/00; E05F 17/00; E05F 2017/005; E06B 3/4636; E05Y 2900/404
(Continued)

(56) References Cited

U.S. PATENT DOCUMENTS 4,713,663 A * 12/1987 Drabowitch ..... B61L 3/125 342/104
5,420,883 A * 5/1995 Swensen ..... B61L 3/125 342/450
(Continued)

FOREIGN PATENT DOCUMENTS

JP 2011-213334 A 10/2011

*Primary Examiner* — Emily C Terrell
(74) *Attorney, Agent, or Firm* — Muncy, Geissler, Olds & Lowe, P.C.

(57) ABSTRACT

In a ground apparatus system, polling communication where a ground apparatus serves as a primary station and a train serves as a secondary station is performed. A ground apparatus that is a ground apparatus of the ground apparatus system and is capable of communicating with a platform screen door control apparatus performs polling communication at a first communication frequency to obtain train location information from the train. When the train reaches an impending arrival range including a stop position at a station, the ground apparatus switches the communication frequency to a second communication frequency higher than the first communication frequency. The apparatus then transmits, to the train through polling communication, synchronized opening and closing control instruction information received from the platform screen door control apparatus, and transmits, to the platform screen door control apparatus, train state information obtained from the train through polling communication.

11 Claims, 15 Drawing Sheets

(51) Int. Cl.
*B61L 23/00* (2006.01)
*B61L 27/00* (2006.01)
*B61L 25/02* (2006.01)

(58) Field of Classification Search
USPC ..... 340/994, 539.17
See application file for complete search history.

(56) References Cited

U.S. PATENT DOCUMENTS

| | | | | |
|---|---|---|---|---|
| 5,613,654 | A * | 3/1997 | Gellermann | B61L 3/008 246/182 B |
| 2005/0133673 | A1* | 6/2005 | Sugita | B61L 3/125 246/167 R |
| 2013/0325211 | A1* | 12/2013 | El Fassi | B61L 11/08 701/2 |
| 2015/0246679 | A1* | 9/2015 | Radczimanowski | B61B 1/02 104/28 |
| 2016/0046307 | A1* | 2/2016 | Miyajima | B60L 15/40 701/19 |

* cited by examiner

FIG. 5

[GROUND INFORMATION
(TRAVELING CONTROL INFORMATION)]

| |
|---|
| DESTINATION TRAIN ID |
| TRANSMISSION SOURCE GROUND APPARATUS ID |
| COMING-IN ALLOWABLE RANGE |
| ⋮ |
| SYNCHRONIZED OPENING AND CLOSING CONTROL INSTRUCTION INFORMATION (PLATFORM SCREEN DOOR OPEN/CLOSED STATE,...) |
| ⋮ |

FIG. 6

[REPLY INFORMATION]

| |
|---|
| DESTINATION GROUND APPARATUS ID |
| TRANSMISSION SOURCE TRAIN ID |
| TRAIN LOCATION INFORMATION |
| TRAIN SPEED INFORMATION |
| ⋮ |
| VEHICLE STATE INFORMATION (VEHICLE DOOR OPEN/CLOSED STATE,...) |
| ⋮ |

FIG. 12

224

GROUND APPARATUS INFORMATION

| GROUND APPARATUS ID | GROUND APPARATUS TYPE | IMPENDING ARRIVAL RANGE | CORRESPONDING CONTROL SECTION | | RADIO COMMUNICATION CONTROL REGION | |
|---|---|---|---|---|---|---|
| | | | BOUNDARY POSITION (ORIGINATING POINT) | BOUNDARY POSITION (END POINT) | TRACKING START POSITION | TRACKING END POSITION |
| XXXXX | — | — | XXX | XXX | XXX | XXX |
| XXXXX | STATION GROUND APPARATUS | XXX～XXX | XXX | XXX | XXX | XXX |
| XXXXX | — | — | XXX | XXX | XXX | XXX |
| ⋮ | ⋮ | ⋮ | ⋮ | ⋮ | ⋮ | ⋮ |

GROUND APPARATUS AND GROUND APPARATUS SYSTEM FOR TRAIN PLATFORM DOOR OPENING AND CLOSING SYNCHRONIZATION THROUGH GROUND APPARATUS COMMUNICATION NETWORKING

CROSS REFERENCE TO RELATED APPLICATION

This application is a continuation of International Patent Application No. PCT/JP2016/064110, having an international filing date of May 12, 2016, which designated the United States, the entirety of which is incorporated herein by reference.

BACKGROUND

Installation of platform screen doors on platforms at stations of a railway and the like has been promoted in order to prevent accidents of falling from platforms, accidents of contacting with a train and the like. Various types of platform doors have been known; the doors include a full-screen type platform screen door that isolates a platform to the ceiling or close to the ceiling, a platform screen door that is called a platform fence and opens and closes a waist-height door, and a rope type screen door that opens and closes by raising and lowering a laterally laid rope or bar. All the platform screen doors are the same in that the doors are subjected to open and close control in synchronization with train doors of a train having arrived at a station and stopped at a fixed position. For example, JP-A-2011-213334 discloses the open and close control.

Incidentally, in recent years, development of a wireless train control system has been promoted in which train position detection using a track circuit is replaced with on-board position detection, and communication is wirelessly achieved between the ground side and train side.

Simple achievement of opening and closing the platform screen doors and the train doors in synchronization in this wireless train control system requires a dedicated communication unit for confirming the door open/closed state of both the on-board doors and the ground doors besides the communication unit that notifies the ground of the train position detected by the trains, in order to determine whether the train has stopped at a fixed position or not. Furthermore, there are demands of detecting the train's stopping at the fixed position in real time, and of achieving opening and closing in synchronization with good responsiveness in a short time period.

SUMMARY

According to one aspect of the invention, there is provided a ground apparatus of a ground apparatus system in which a plurality of ground apparatuses are provided along a predetermined railway route to perform radio communication with a train, the plurality of ground apparatuses being disposed so that radio communication control regions of adjacent ground apparatuses partially overlap each other in order to prevent occurrence of a communication blank zone of the radio communication, the ground apparatus being configured to be capable of communicating with a platform screen door control device for a platform screen door installed at a station where the train stops, the radio communication being polling communication in which the ground apparatus serves as a primary station, and the train serves as a secondary station, the train being configured to reply with reply information including train location information, and train state information to be used in cases where the platform screen door is opened and closed in synchronization with a train door, when polling from the ground apparatus is received, the reply information serving as a reply to the polling, the ground apparatus, comprising:

a radio communication control unit that performs the polling communication at a given communication frequency, and obtains the reply information from the train;

a communication frequency control unit that sets the communication frequency to a first communication frequency, uses the train location information obtained from the train through the polling communication to determine whether the train reaches a predetermined impending arrival range including a stop position at the station or not, and switches the communication frequency to a second communication frequency higher than the first communication frequency when the train reaches the impending arrival range; and a door-synchronized opening and closing time relay that communicates with the platform screen door control device at times of door opening and closing in synchronization, transmits, to the train through the polling communication, given synchronized opening and closing control instruction information received from the platform screen door control device, and transmits the train state information obtained from the train through the polling communication, to the platform screen door control device.

BRIEF DESCRIPTION OF DRAWINGS

FIG. 5 is a diagram illustrating a format example of ground information.

FIG. 6 is a diagram illustrating a format example of reply information.

FIG. 12 is a diagram illustrating a data configuration example of ground apparatus information.

DESCRIPTION OF EXEMPLARY EMBODIMENTS

Figure 1:
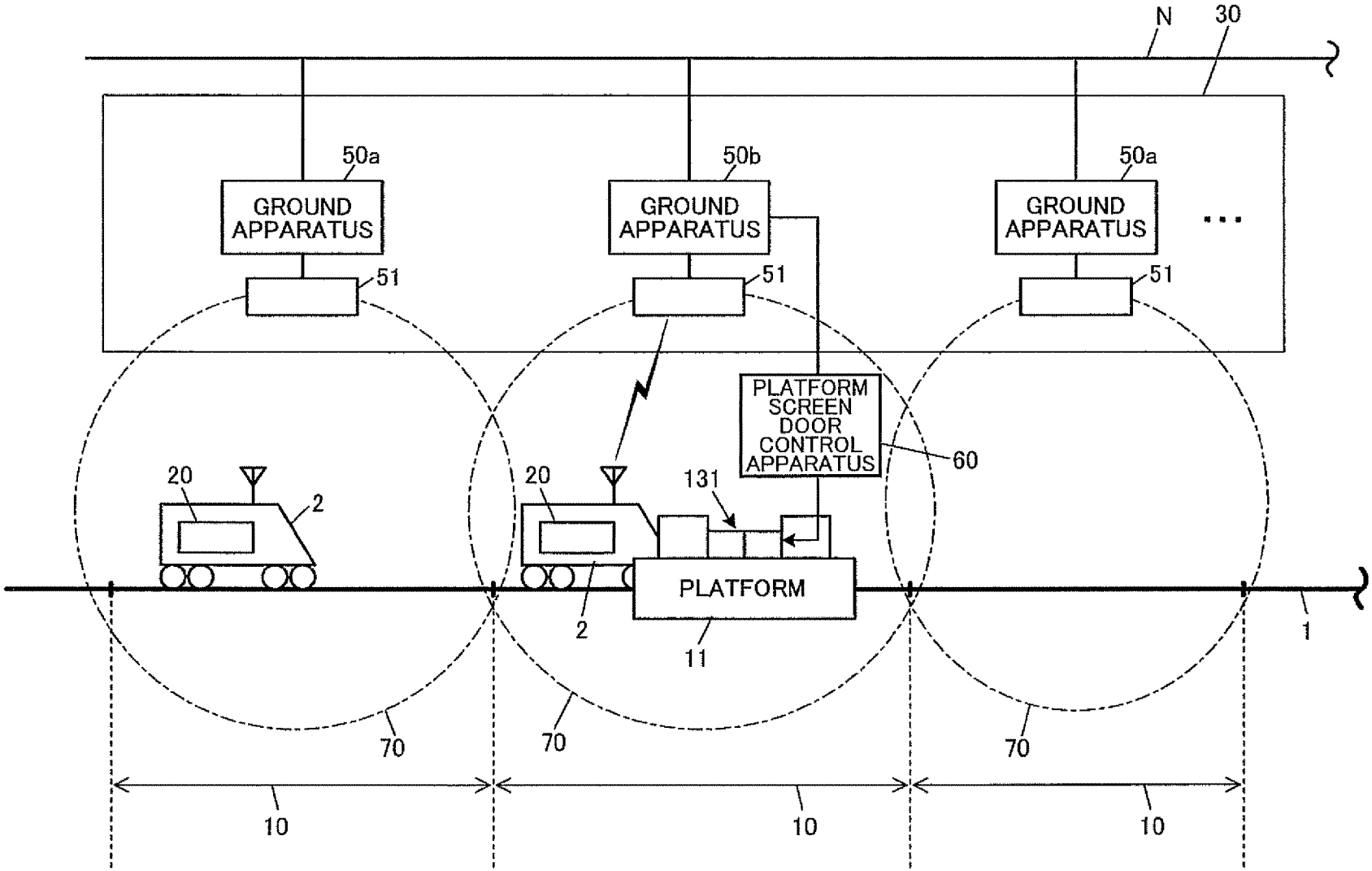
FIG. 1 is a diagram illustrating an example of an overall configuration of an on-rail train management system.

According to one embodiment of the invention, there is provided a ground apparatus of a ground apparatus system in which a plurality of ground apparatuses are provided along a predetermined railway route to perform radio communication with a train, the plurality of ground apparatuses being disposed so that radio communication control regions of adjacent ground apparatuses partially overlap each other in order to prevent occurrence of a communication blank zone of the radio communication, the ground apparatus being configured to be capable of communicating with a platform screen door control device for a platform screen door installed at a station where the train stops, the radio communication being polling communication in which the ground apparatus serves as a primary station, and the train serves as a secondary station, the train being configured to reply with reply information including train location information, and train state information to be used in cases where the platform screen door is opened and closed in synchronization with a train door, when polling from the ground apparatus is received, the reply information serving as a reply to the polling, the ground apparatus, comprising:

a radio communication control unit that performs the polling communication at a given communication frequency, and obtains the reply information from the train;

a communication frequency control unit that sets the communication frequency to a first communication frequency, uses the train location information obtained from the train through the polling communication to determine whether the train reaches a predetermined impending arrival range including a stop position at the station or not, and switches the communication frequency to a second communication frequency higher than the first communication frequency when the train reaches the impending arrival range; and a door-synchronized opening and closing time relay that communicates with the platform screen door control device at times of door opening and closing in synchronization, transmits, to the train through the polling communication, given synchronized opening and closing control instruction information received from the platform screen door control device, and transmits the train state information obtained from the train through the polling communication, to the platform screen door control device.

According to this embodiment, at least to grasp the position of the train, polling communication can be performed with the train, and in the ground apparatus configured to be capable of communicating with the platform screen door control device of the platform screen door installed at the station, transmission and reception of data for door control required to open and close the platform screen door and the train door in synchronization can be relayed at a required communication frequency. That is, during the polling communication with the train, the ground apparatus can transmit, to the train, the synchronized opening and closing instruction information received from the platform screen door control apparatus. Meanwhile, the apparatus can obtain the train state information together with the train information during reply from the train in response to the polling, and transmit the obtained train state information to the platform screen door control apparatus.

In this case, when the train reaches the predetermined impending arrival range around the stop position at the station, the communication frequency of the polling communication can be switched to a second communication frequency higher than the previous first communication frequency. The communication frequency means the number of communications in a constant time. The higher the frequency is, the larger the number of communications in the constant time is, and the communication interval decreases. It can be determined whether the impending arrival range is reached or not on the basis of the train location information obtained through the previous polling communication. Accordingly, in the train, opening and closing of the train doors can be controlled using the synchronized opening and closing control instruction information from the platform screen door control apparatus. In the platform screen door control apparatus, opening and closing of the platform screen doors can be controlled using the train state information from the train. Consequently, opening and closing control of the platform screen doors and the train doors in synchronization can be achieved without any need of a dedicated communication unit for transmitting and receiving the data for door control. Furthermore, since reaching the impending arrival range makes the communication frequency highly frequent, opening and closing the platform screen doors and the train doors in synchronization can be achieved with good responsiveness in a short time period.

The ground apparatus may further comprise a stop position determination and notification unit that uses the train location information obtained from the train through the polling communication to determine whether the train is positioned at the stop position at the station or not, and notifies the platform screen door control device of a determination result thereof.

It is confirmed that the train arriving at the station stops at a stop position, and then synchronized opening and closing control of the platform screen door and the train door is started. According to this embodiment, the ground apparatus can determine that the train stops at the stop position on the basis of the train location information obtained through the polling communication, and transmit the determination result to the platform screen door control device. To determine, in a short time period, that the train stops at the stop position at the station, the train location information is required to be obtained at a high frequency. However, the fact that the train stops at the stop position means that the train reaches the impending arrival range, and the communication frequency is automatically switched to the high frequency. Accordingly, the detection can be performed in a short time period after the train stops at the stop position at the station.

In the ground apparatus, wherein the communication frequency control unit may further execute switching the communication frequency from the second communication frequency to the first communication frequency in response to departure of the train from the station.

According to this embodiment, when the train departs the station, the frequency of the polling communication can be returned to the first communication frequency.

In the ground apparatus, wherein the communication frequency control unit may further execute switching the communication frequency from the second communication frequency to the first communication frequency in response to the train's traveling outside of the impending arrival range.

According to this embodiment, when the train travels outsides the impending arrival range, the frequency of the polling communication can be returned to the first communication frequency.

The ground apparatus may further comprise a storage unit that stores a train list that is a list of train identification information on management target trains allowing the ground apparatus to communicate therewith through the radio communication, wherein the radio communication control unit may perform the polling communication with each train included in the train list, and the communication frequency control unit may control changing of the communication frequency of the polling communication, for each train included in the train list.

According to this embodiment, the ground apparatus can obtain the train location information from the management target train, by performing the polling communication with each train included in the train list. Then, according to the obtained train location information from the management target train, the communication frequency of the polling communication can be switched to the second communication frequency that is a high frequency, for the train reaching the impending arrival range.

Hereinafter, referring to the diagrams, preferable embodiments of the invention are described. The invention is not limited by the embodiments described below. Embodiments to which the invention is applicable are not limited to the following embodiments. In the description of the diagrams, the same parts are assigned the same symbols.

FIG. 1 is a diagram illustrating an overall configuration example of an on-rail train management system according to this embodiment. As illustrated in FIG. 1, the on-rail train management system includes: an on-board apparatus 20 mounted on a train 2 traveling on a track 1; and ground apparatuses 50 (50*a* and 50*b*) that wirelessly communicate with the on-board apparatus 20. The ground apparatuses 50 are communicatively connected to each other by a network N.

In the on-rail train management system, the ground apparatus 50, which serves as a primary station, wirelessly communicates with the train 2 (the on-board apparatus 20 in actuality), which serves as a secondary station, according to a polling scheme (polling communication). The polling communication is radio communication according to which the primary station sequentially queries all the secondary stations using a list of the secondary stations (polling list) and each secondary station responds to the inquiry to thereby transmit and receive required data (transmission data). In this embodiment, the ground apparatus 50 uses, as the polling list, a train list where train IDs of management target trains 2 are set, and transmits, to the on-board apparatus 20, the ground information that is traveling control information for the trains that includes a coming-in allowable range (that may also be called a coming-in limit position), through polling communication. In response to the polling from the ground apparatus 50, the on-board apparatus 20 then replies with the reply information that includes train location information (the position of the own train) and train speed information (the speed of the train itself).

Here, the coming-in allowable range represents a coming-in range (coming-in limit position) on the track 1 allowed for the own train, and is calculated as, for example, the distance or the like from the position of the train 2, by the ground apparatus 50 serving as a management administrator that manages the train 2 as a target. That is, the ground apparatus 50 calculates the coming-in allowable range as required, on the basis of the positions of the management target train 2 and the preceding train 2 for each of the management target trains 2, and includes the calculated range in the ground information destined for the train 2 concerned in the case of polling communication.

Furthermore, in the ground information and the reply information, required data, such as transmission time point, and a CRC code for error detection, for example, is appropriately set. Data included, as transmission data, in the ground information and the reply information is also set appropriately. Besides the coming-in allowable range, for example, the traveling control information or the like required by the train 2 to control traveling of the own train is appropriately included in the ground information. Traveling information or the like to be obtained from the train 2 by the ground apparatus 50 to create the traveling control information is appropriately included in the reply information.

In conformity with the coming-in allowable range included in the ground information (traveling control information) received from the ground apparatus 50, the on-board apparatus 20 creates a speed check pattern on the basis of the position of the own train, and performs traveling control. The on-board apparatus 20 always measures the position and the speed of the own train using the number of revolutions of an axle counted by a tachometer, for example.

The ground apparatuses 50 are disposed for the respective control sections 10 segmented from the track 1 at predetermined boundary positions to constitute a ground apparatus system 30, and manages the trains 2 present in the control sections 10 on the basis of the train location information obtained from the trains 2 and controls the railway operation.

The ground apparatuses 50 include radio base stations 51. Each radio base station 51 is installed at an appropriate site along the track 1 so as to create no non-communication zone between the trains 2 on the track 1. In this embodiment, for the sake of simplifying the description, the number of radio base stations 51 included in each ground apparatus 50 is one. The radio base stations 51 are installed so that their radio communication control regions 70 include the entire regions of the respective control sections (hereinafter appropriately called "corresponding control sections") where the ground apparatuses 50 are disposed, and the radio communication control regions 70 partially overlap each other at boundary portions with the adjacent control sections 10.

The number of radio base stations 51 included in each ground apparatus 50 is not limited to one. Alternatively, the number may be two or more. It is only required that the control section(s) 10 controlled by one ground apparatus 50 can be covered by the radio communication control region(s) 70 due to X (X≥1) radio base station(s) 51 included in the ground apparatus(es) 50.

The case is not limited to that provided with the radio base station 51. Alternatively, the radio communication control region 70 may be formed using a loop antenna or a leaky coaxial cable (LCX) that is laid along the track 1.

The ground apparatuses 50 are communicatively connected to at least the next ground apparatuses 50 adjacent in the traveling direction of the train 2 (the forward sense in the train traveling direction) in a manner capable of data transmission and reception. This embodiment assumes that the ground apparatuses 50 are communicatively connected to each other via the network N.

Here, the ground apparatus 50*b* includes a station (in particular, a part of the track 1 along a platform 11 of the station) in the corresponding control section 10. The ground apparatus 50*b* is communicatively connected to a platform screen door control apparatus 60 that applies opening and closing control to a platform screen door 131 in a manner capable of transmitting and receiving data, and has a function of relaying data for door control that relays data for door control in addition to a railway presence detection function that is a function of the ground apparatus 50*a*. That is, the ground apparatus 50*b*, whose corresponding control section 10 includes the station, relays transmission and reception of the data for door control between the platform screen door control apparatus 60 and the train 2 in order to make platform screen doors 131 and train doors 281 (see FIG. 4) open and close in synchronization in cases where the train 2 reaches and departs the corresponding station. Hereinafter, the ground apparatus 50*b* is also called "station ground apparatus 50*b*" appropriately.

Principle

1. Railway Presence Detection of Train (Polling Communication)

Figure 2:
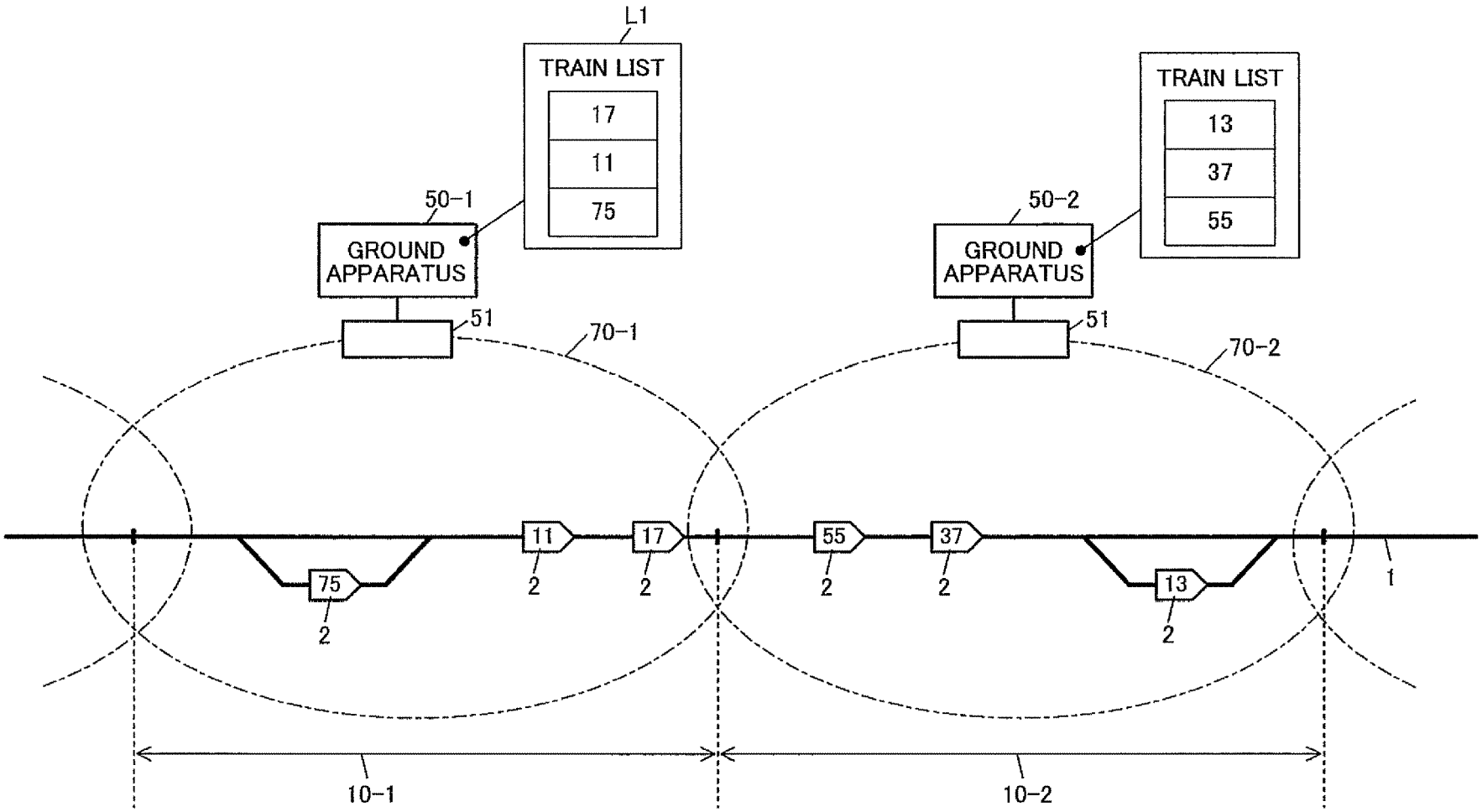
FIG. 2 is a diagram illustrating an example of railway presence situations of trains in adjacent two control sections.
Figure 3:
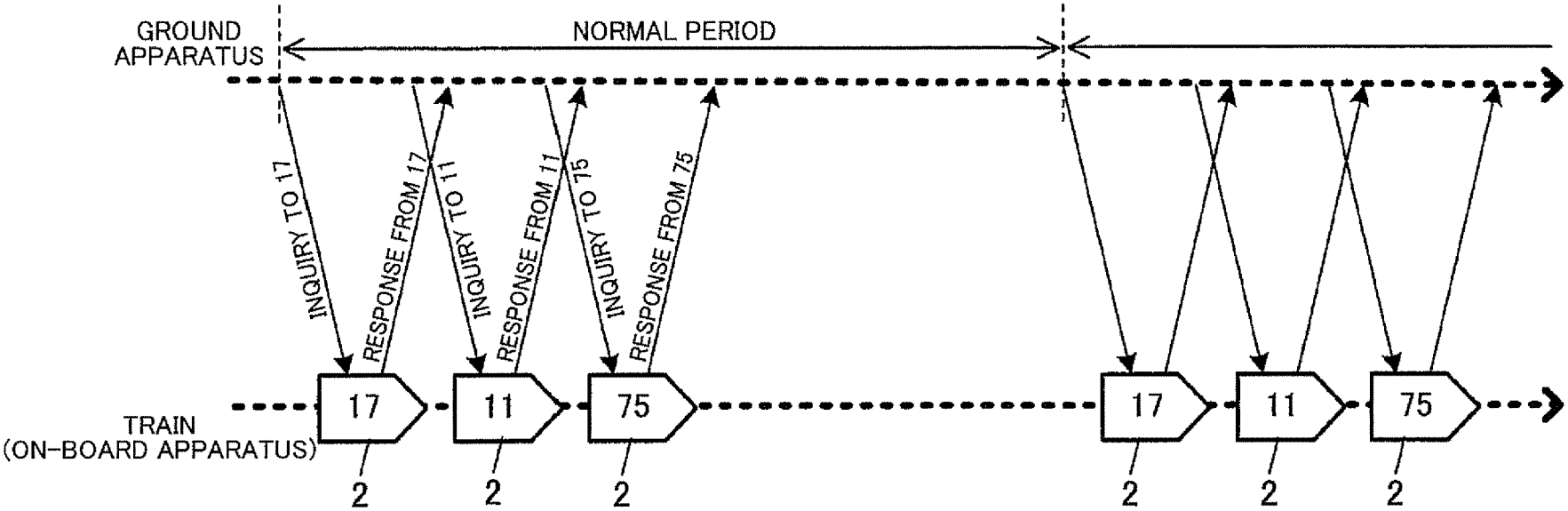
FIG. 3 is a diagram illustrating polling communication.

FIG. 2 is a diagram illustrating an example of railway presence situations of trains 2 in adjacent two control sections 10 (10-1 and 10-2). FIG. 3 is a diagram illustrating polling communication, and illustrates the polling communication performed by the ground apparatus 50-1 in the control section 10-1, the apparatus serving as a primary station in the railway presence situation in FIG. 2.

Each of the ground apparatuses 50 constituting the ground apparatus system 30 holds the train list in which the train ID (train identification information) of the train 2 serving as a management target of the own apparatus at a present time point is set. In particular, each ground apparatus 50 adopts, as a management target, the train 2 capable of polling communication, i.e., the train 2 present in the radio communication control region 70. Information including the train IDs pertaining to the trains 2 exiting and approaching is exchanged between the ground apparatuses 50 whose corresponding control sections 10 are adjacent to each other, and a process of handover (roaming) the train ID with which the train list is to be updated. Accordingly, the train ID of the train 2 newly approaching the corresponding control section 10 is added to the train list, starts polling communication, with the train 2 being adopted as the management target, and removes the train ID of the train 2 exiting the corresponding control section 10 from the train list, thus allowing the train 2 to be excluded from the management targets. According to the example in FIG. 2, the train IDs "17", "11" and "75" of three trains 2 in the radio communication control region 70-1 are set in the train list L1 of the ground apparatus 50-1.

Each ground apparatus 50 uses the train list to perform polling communication periodically with the management target train 2, at a predetermined inquiry period (hereinafter "normal period") required for railway presence detection, in other words, a communication frequency that is once a normal period (first communication frequency; hereinafter, referred to as "normal frequency"), thereby detecting the presence (position) of the train 2 in the corresponding control section 10. For example, as illustrated in FIG. 3, the ground apparatus 50-1 issues queries by sequentially transmitting pieces of ground information destined for the trains 2 having the train IDs "17", "11" and "75" set in the train list L1 (see FIG. 2). The apparatus then obtains pieces of reply information transmitted by the on-board apparatuses 20 of the trains 2 having the train IDs "17", "11" and "75" in response to the respective queries. If the reply information is obtained, the presence of the train 2 pertaining to the train information can be confirmed. The train location information included in the train information allows the position of the train 2 to be grasped. The normal frequency is appropriately set, such as to 1 or 0.5 [times/sec.], for example.

As a result of the polling communication periodically performed as described above, the ground apparatus 50 identifies a communication-interrupted train upon detection of presence of a train 2 with the communication being interrupted in the corresponding control section 10. More specifically, if there is a train (communication-interrupted train) 2 that does not reply to the inquiry and does not normally communicate among the trains 2 to be present in the corresponding control section 10 among the management target trains 2, the train 2 is determined as the communication-interrupted train. It is then assumed that the communication-interrupted train is present at the train position indicated by the train location information included in the train information received through the last polling communication with the train 2, and the coming-in allowable range of another train 2 is set. Meanwhile, if there is no polling communication in a predetermined time with the ground apparatus (hereinafter appropriately called "opposite ground apparatus") 50 in the control section 10 where the own train resides, the on-board apparatus 20 determines that the communication with the opposite ground apparatus 50 is interrupted. That is, the on-board apparatus 20 determines by itself that the own train 2 is the communication-interrupted train. If it is determined that the communication is interrupted, the train 2 emergently stops.

According to this railway presence detection, periodical radio communication that is polling communication using the train list can achieve railway presence detection of the train 2 in units of control sections 10 without providing a train detection unit on the ground. In case there is a communication-interrupted train, the ground apparatus 50 assumes that the position indicated by the last train location information on the communication-interrupted train obtained through the polling communication is the train position of the communication-interrupted train, and calculates and sets the coming-in allowable ranges of the trains 2 including the other train 2. On the other hand, the train 2 with no polling communication in the predetermined time is emergently stopped, which can achieve safe railway operation control.

2. Function of Relaying Data for Door Control

Next, a function of relaying the data for door control in the station ground apparatus 50*b* is described. First, an overview of the door opening and closing system is described. The station ground apparatus 50*b*, together with the train 2 reaching the station in the corresponding control section 10, the platform screen door control apparatus 60 and the like, constitutes the door opening and closing system, and opens and closes the platform screen doors 131 and the train doors 281 in synchronization in conformity with reaching and departure of the train 2 to and from the station.

Figure 4:
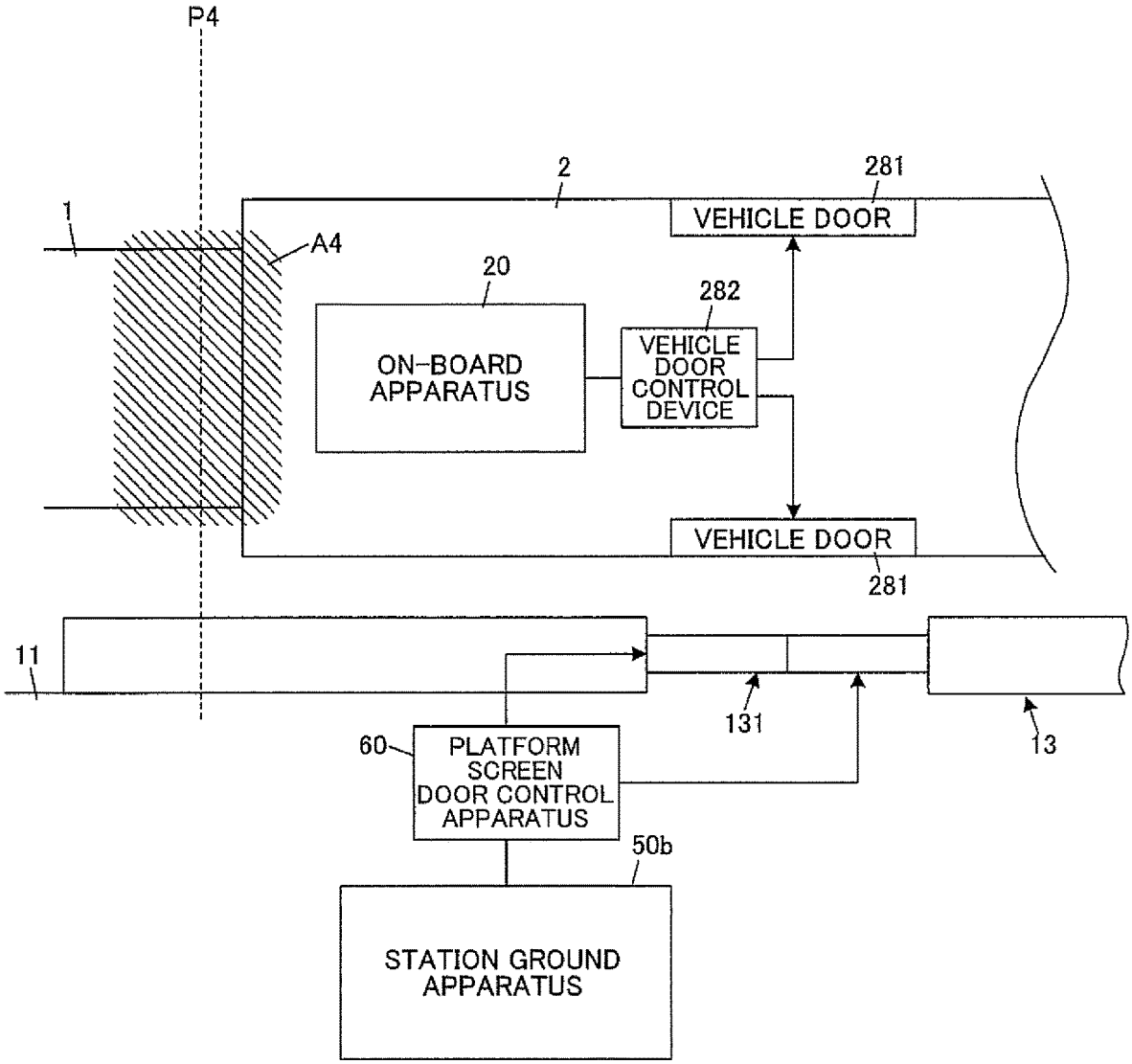
FIG. 4 is a schematic configuration diagram of a door opening and closing system.

FIG. 4 is a schematic configuration diagram of the door opening and closing system. As illustrated in FIG. 4, the door opening and closing system includes, as facilities on the ground: the station ground apparatus 50*b*; the platform screen doors 131 of the platform fence 13 provided on the platform 11; and the platform screen door control apparatus 60. Furthermore, the system includes, as facilities on the train 2: the on-board apparatus 20; the train doors 281 provided on train bodies; and a train door control device 282 that controls opening and closing the train doors 281. Here, the platform screen doors 131 are positioned so as to be opposed to the respective train doors 281 of the train 2 when the train 2 reaches the station and is stopped at a fixed position P4.

The door opening and closing system determines whether the train 2 reaching the station is stopped at the fixed position P4 or not (stop determination). For example, when the train 2 is stopped to have its distal end position accommodated in a fixed position range A4 with reference to the fixed position P4, the system determines that the train 2 is stopped at the fixed position P4. In this embodiment, the on-board apparatus 20 measures the position and the speed of the own train. Accordingly, based on these position and speed, the fact that the own train is stopped and the stop position can be identified. The determination of stopping at the fixed position is performed by the station ground apparatus 50*b*, for example. That is, the station ground apparatus 50*b* determines whether the train 2 is stopped at the fixed position or not on the basis of the train location information and train speed information obtained as required from the train 2 through polling communication.

Note that the determination of stopping at the fixed position may be performed using only the train location information. For example, if the difference (positional deviation) between the train position indicated by the train location information immediately previously received and the train location information received this time is within a predetermined positional deviation allowable range (e.g., 5 cm or zero), it is determined to be stopped. If the deviation between the train position indicated by the train location information received this time and the fixed position P4 is within an allowable range (e.g., a distance approximately ranging from 20 to 50 cm), it is determined to be positioned at the fixed position P4. It is thus determined to be finally stopped at the fixed position. Instead of determination based on the sequentially received two pieces of train location information, determination may be performed based on sequentially received three pieces of train location information.

Alternatively, the determination of stopping at the fixed position may be performed by the on-board apparatus 20, and the determination result may be included in the reply information, which may then be transmitted to the station ground apparatus 50*b*.

If it is determined that the train 2 is stopped at the fixed position P4 on the basis of the determination of stopping at the fixed position, the platform screen door control apparatus 60 causes the platform screen doors 131 to perform an opening operation. The opening operation of the platform screen doors 131 may be started automatically in response to the fact that the train 2 is stopped at the fixed position P4, or started after an operator's operation input is accepted. The opening operation of the train doors 281 by the train door control device 282 is performed at the same time as the operation of opening the platform screen doors 131. Alternatively, the opening operation may be after the platform screen doors 131 are completely opened, or the opening operation may be started before the operation of opening the platform screen doors 131.

On the other hand, after passengers finish boarding and alighting, the platform screen door control apparatus 60 causes the platform screen doors 131 to perform a closing operation. The closing operation of the platform screen doors 131 may be started automatically when a departure time point at which the train 2 departs the station is reached, or started after the operator's operation input is accepted. The closing operation of the train doors 281 by the train door control device 282 is performed at the same time as the operation of closing the platform screen doors 131. Alternatively, the train doors 281 may be completely closed before the operation of closing the platform screen doors 131 is started, or the closing operation may be started after the operation of closing the platform screen doors 131.

To open and close the platform screen doors 131 and the train doors 281 in synchronization as described above, the train 2 is required to obtain, for example, the open/closed state of the platform screen doors 131, an instruction of opening the train doors 281 accompanying the opening of the platform screen doors 131 and the like from the platform screen door control apparatus 60, while the platform screen door control apparatus 60 is required to obtain, for example, the open/closed state of the train doors 281, an instruction of closing the platform screen doors 131 accompanying the closing of the train doors 281 and the like from the train 2. To start the opening operation of the platform screen doors 131, the platform screen door control apparatus 60 is required to know whether the train 2 is stopped at the fixed position P4 or not.

The function of relaying data for door control is a function of relaying the data for door control required therefor between the on-board apparatus 20 and the platform screen door control apparatus 60, and uses polling communication to be performed by the railway presence detection function. That is, the station ground apparatus 50*b* includes, in the ground information, synchronized opening and closing control instruction information that is data for door control destined for the train 2, in a case of the polling communication, and transmits the information to the on-board apparatus 20. Meanwhile, in response to the polling from the station ground apparatus 50*b*, the on-board apparatus 20 includes, in reply information, train state information that is data for door control destined for the station ground apparatus 50*b*, and replies with the information.

FIG. 5 is a diagram illustrating a format example of the ground information that is the traveling control information to be transmitted by the station ground apparatus 50*b*. FIG. 6 is a diagram illustrating a format example of the reply information with which the on-board apparatus 20 replies to the station ground apparatus 50*b*. First, the ground information includes a destination train ID of the ground information, a transmission source ground apparatus ID transmitting the ground information, the coming-in allowable range, and the synchronized opening and closing control instruction information.

The synchronized opening and closing control instruction information includes not only the exemplified open/closed state of the platform screen doors 131 but also data to be obtained from the platform screen door control apparatus 60 in order to allow the train door control device 282 to perform the opening and closing control of the train doors 281, such as a door opening and closing instruction for the train doors 281, and is transmitted from the platform screen door control apparatus 60. The station ground apparatus 50*b* receives the information from the platform screen door control apparatus 60 and includes the information in the ground information, thereby transmitting the synchronized opening and closing control instruction information issued from the platform screen door control apparatus 60, to the train 2 as required. The on-board apparatus 20 then transmits (transfers) the synchronized opening and closing control instruction information included in the received ground information, together with the transmission source ground apparatus ID, to the train door control device 282 as required.

Next, the reply information includes a destination ground apparatus ID of the reply information, a transmission source train ID of the reply information, the train location information, the train speed information, and the train state information.

The train state information includes not only the exemplified open/closed state of the train doors 281 but also data to be obtained from the train door control device 282 in order to allow the platform screen door control apparatus 60 to perform the opening and closing control of the platform screen doors 131, such as a door opening and closing instruction for the platform screen doors 131, and is transmitted from the train door control device 282. The on-board apparatus 20 receives the information, and includes the information in reply information in response to the polling from the station ground apparatus 50*b*.

The station ground apparatus 50*b* then transmits (transfers) the train state information included in the obtained reply information, together with the transmission source train ID, to the platform screen door control apparatus 60 as required. At this time, this apparatus performs the above-referenced stop determination on the basis of the train location information and the train speed information included in the reply information. Then, the platform screen door control apparatus 60 is also notified of a train fixed position flag 546 in which the determination result is set (see FIG. 9). The train fixed position flag 546 is set to OFF until the train 2 is stopped at the fixed position P4. The setting is replaced with ON when it is determined that the train 2 is stopped at the fixed position P4. When the train 2 starts moving and departs the station, the flag is reset to OFF.

Figure 7:
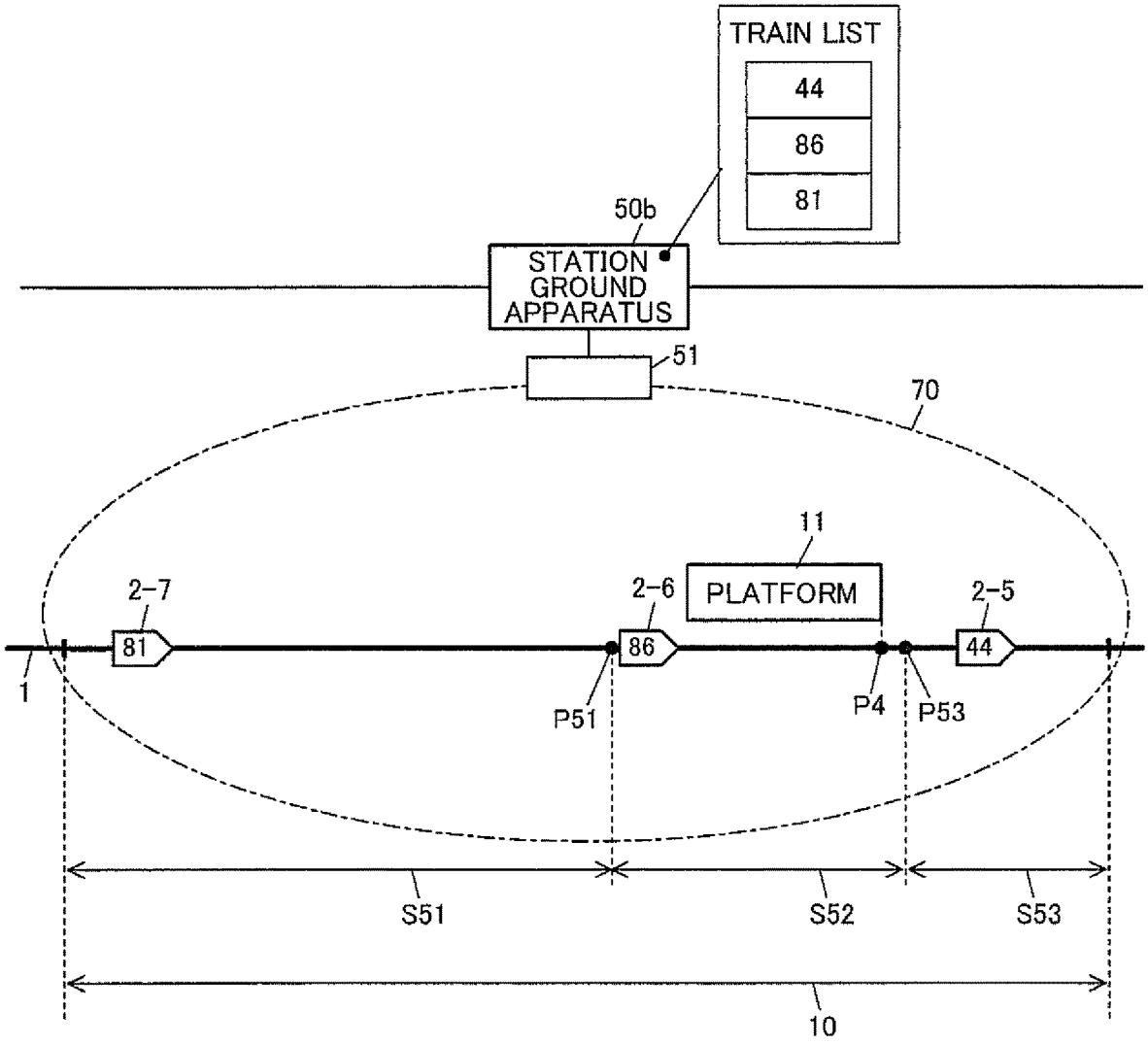
FIG. 7 is a diagram illustrating an example of railway presence situations of trains in a corresponding control section of a station ground apparatus.

The overview of the function of relaying data for door control has thus been described above. Firstly, the data for door control is not necessarily always relayed with all the management target trains 2. Alternatively, it is sufficient to relay the data with the train 2 reaching and departing the station. FIG. 7 is a diagram illustrating an example of railway presence situations of trains 2 in the corresponding control section 10 of the station ground apparatus 50*b*. The example in FIG. 7 illustrates situations where three trains 2 (2-5, 2-6 and 2-7) are traveling in the corresponding control section 10, and the train 2-6 among the trains reaches an impending arrival range S52.

In this embodiment, the impending arrival range S52 is preliminarily defined in conformity with the range (a part along the platform 11) of the station in the corresponding control section 10. The impending arrival range S52 is set as a range including the fixed position P4. FIG. 7 illustrates a range of parts P51 to P53 along the platform 11 as the impending arrival range S52. The station ground apparatus 50*b* then relays transmission and reception of the data for door control in the case of polling communication with the train (hereinafter, referred to as "relay target train") 2-6 in the impending arrival range S52. On the other hand, the trains 2-5 and 2-7 in the ranges S51 and S53 outside of the impending arrival range are not regarded as targets of relaying the data for door control. That is, the station ground apparatus 50*b* performs polling communication with the trains 2-5 and 2-7 other than the relay target train 2-6 using the same data content as that performed by the other ground apparatus 50*a* (i.e., without setting the synchronized opening and closing control instruction information in the ground information, and without setting the train state information in the reply information).

Secondly, transmission and reception of the data for door control require a higher communication frequency (hereinafter, referred to as "relay frequency") than the normal frequency required for railway presence detection. As described above, the normal frequency is about 1 [time/sec.], for example. Transmission and reception of the data for door control is required to be performed at an interval of 50 to 300 [ms] (hereinafter the inquiry period of polling communication at the relay frequency is called "relay period").

Figure 8:
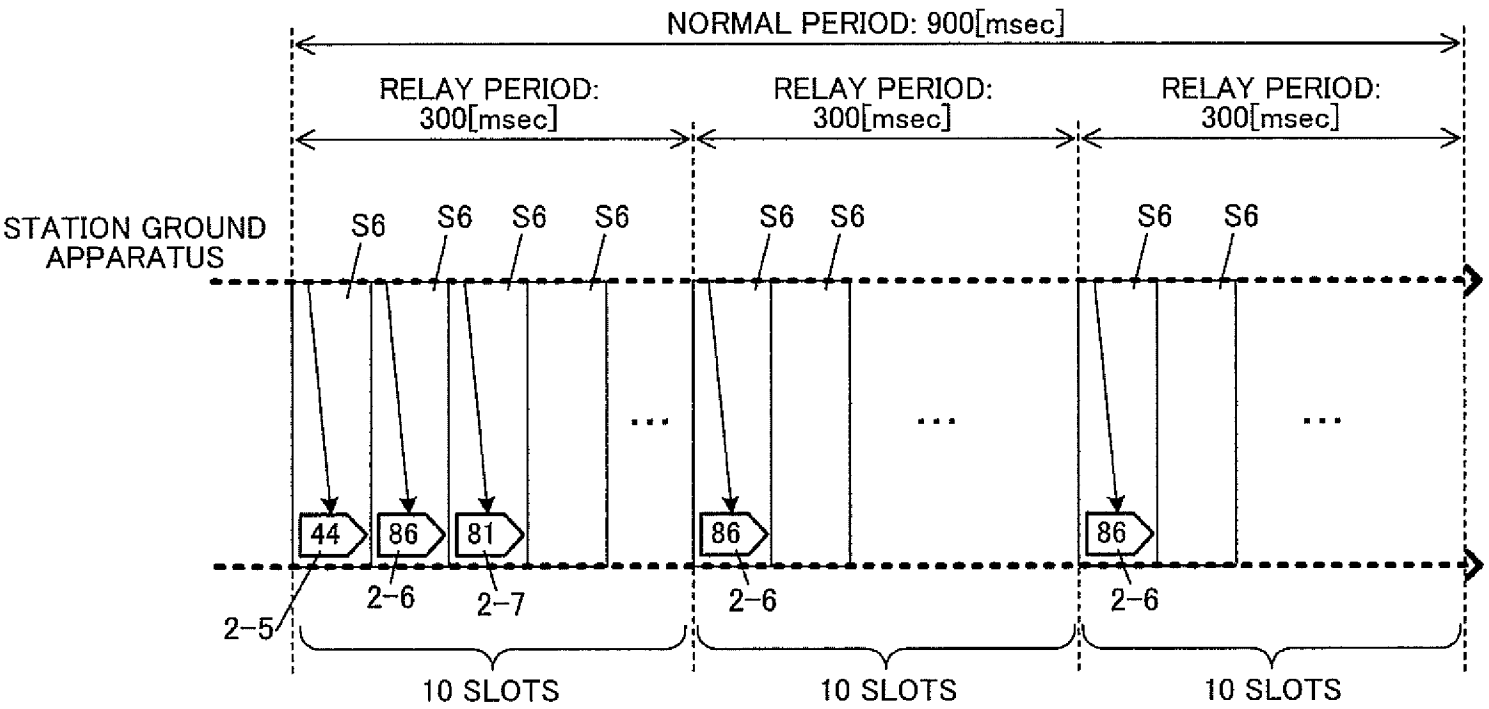
FIG. 8 is a diagram illustrating polling communication the station ground apparatus performs.

FIG. 8 is a diagram illustrating polling communication performed by the station ground apparatus 50*b* in the railway presence situation in FIG. 7. Note that FIG. 8 illustrates only transmission (inquiry) of the ground information from the station ground apparatus 50*b* to the management target train 2. However, reply of the reply information from the train 2 is omitted from the illustration. FIG. 8 also illustrates the normal period as 900 [msec.], and the relay period as 300 [msec.], for example. As illustrated in FIG. 8, the station ground apparatus 50*b* performs polling communication with the trains 2-5 and 2-7 in the ranges S51 and S53 outside of the impending arrival range, once a normal period. On the other hand, polling communication is performed with the relay target train 2 in the impending arrival range S52, once a relay period (three times a normal period).

More specific description is made. For example, the normal period is time-divided to set a time slot, and allocates the management target train 2 to the set time slot, thus predefining the transmission timing of the ground information for the management target train 2 at units of normal periods (transmission timing defining process). The time slot to be allocated is determined in conformity with the communication frequency to be applied to the train 2. In the example in FIG. 8, the relay frequency is three times as high as the normal frequency (in other words, the relay period is ⅓ as long as the normal period). Accordingly, for example, the normal period is time-divided into 30 time slots S6, which are then separated into three blocks each having 10 slots. Each block serves as the relay period. The number of time-divided time slots S6 is an example. Alternatively, the number may be appropriately set. The management target trains 2-5, 2-6 and 2-7, which include the relay target train 2-6, are allocated sequentially from the leading time slot S6 in the first block. The relay target trains 2 are respectively allocated to the leading time slots in the second and third blocks.

The transmission timing defining process is performed when the relay target train 2 reaching the impending arrival range S52 is detected and when the relay target train 2 travels outside of the impending arrival range S52. It can be identified whether the management target train 2 reaches the impending arrival range S52 or not and whether the train 2 travels outside of the impending arrival range S52 or not, on the basis of the train location information obtained through polling communication as required. Accordingly, when the management target train 2 reaches the impending arrival range S52, the station ground apparatus 50*b* can switch the communication frequency of polling communication from the normal frequency to the relay frequency only, for the train concerned (relay target train). When the relay target train 2 travels outside of the impending arrival range S52, the frequency can be returned to the normal frequency. When the train ID is added to the train list, the transmission timing is required to be defined for the train 2. When the train ID is removed from the train list, allocation of the transmission timing to the train 2 becomes unnecessary. Accordingly, when the train list is updated, the transmission timing defining process is also performed.

Alternatively, when the relay target train 2 departs the station, the transmission timing defining process may be performed and the communication frequency with the relay target train 2 may be returned to the normal frequency. The departure of the train 2 can be determined, at least using the train location information obtained through polling communication with the relay target train 2, on the basis of whether the train starts to move from the stop state or not. Alternatively, provided that an end point P53 of the impending arrival range S52 is the fixed position P4, the frequency can be returned to the normal frequency when the relay target train 2 substantially departs the station.

Here, transmission of the synchronized opening and closing control instruction information from the platform screen door control apparatus 60 to the station ground apparatus 50*b* may be always performed irrespective of whether there is any train 2 reaching the station or not. Alternatively, transmission control may be started upon receipt of a train reaching notification about the train 2 from the station ground apparatus 50*b*, and the transmission control may be finished upon receipt of a train departure notification about the train 2. This embodiment adopts the latter case. However, in any of the cases, the platform screen door control apparatus 60 transmits the synchronized opening and closing control instruction information to the station ground apparatus 50*b* at a frequency equivalent to the relay frequency. This is analogously applied to transmission of the train state information from the train door control device 282 to the on-board apparatus 20. The train door control device 282 transmits the train state information to the on-board apparatus 20, at a frequency equivalent to the relay frequency, always, or from the own train reaching the impending arrival range S52 to departure from the impending arrival range S52, for example.

Function Configuration

1. Ground Apparatus

Figure 9:
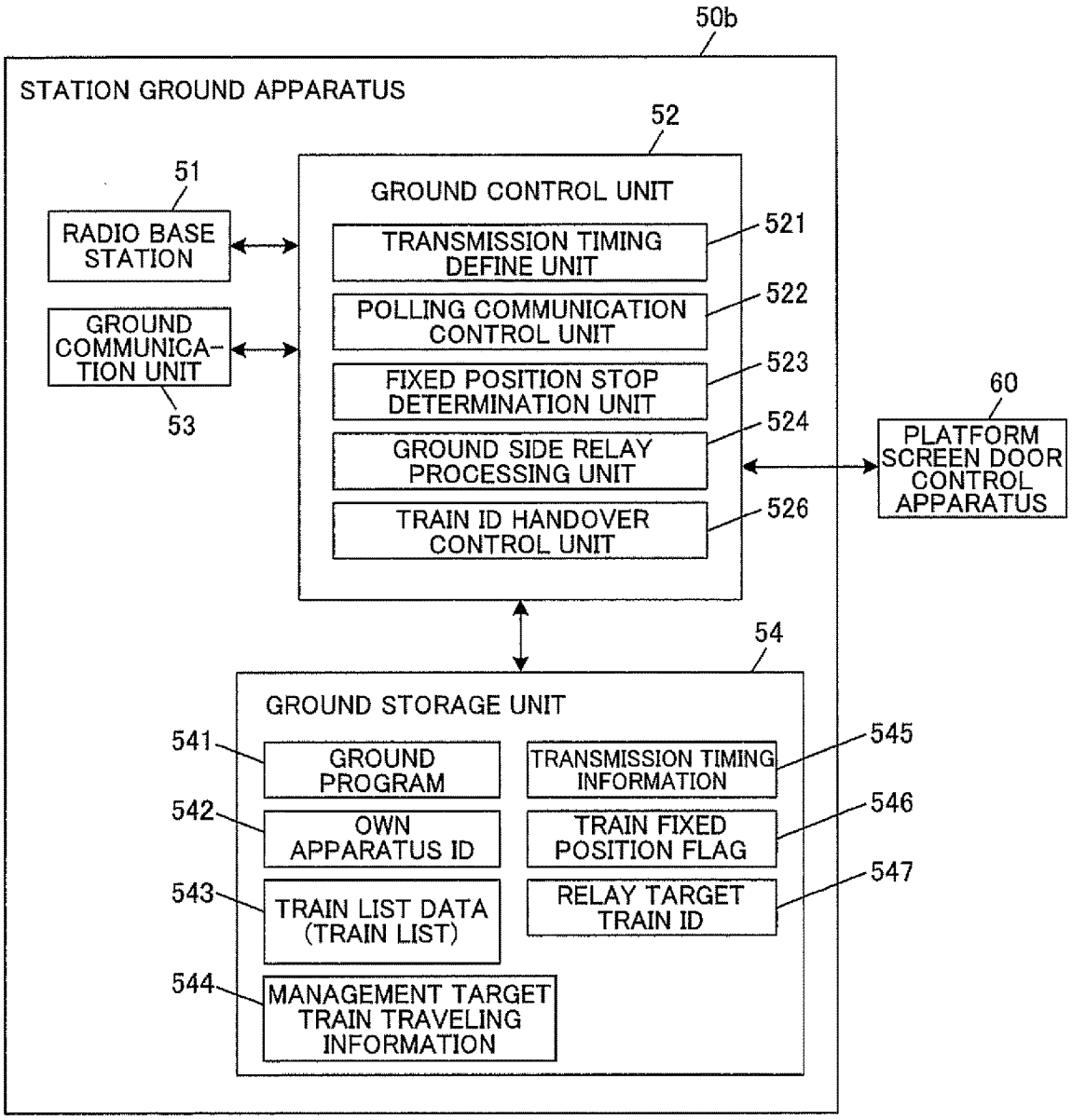
FIG. 9 is a block diagram illustrating a function configuration example of the station ground apparatus.

FIG. 9 is a block diagram illustrating a function configuration example of the station ground apparatus 50*b*. As illustrated in FIG. 9, the station ground apparatus 50*b* is a type of a computer control apparatus that includes a radio base station 51 installed at an appropriate site in proximity to the track 1, a ground control unit 52, a ground communication unit 53, and a ground storage unit 54, and further includes an operation section and a display, which are not illustrated. Although the configuration of the ground apparatus 50*a* is not illustrated, the configuration can be achieved as a configuration obtained by removing parts related to the function of relaying the data for door control from the configuration of the station ground apparatus 50*b*. Alternatively, the ground apparatus 50*a* may have the same configuration as the station ground apparatus 50*b* has. In this case, the function of relaying the data for door control is not used.

The ground control unit 52 includes an operation device or an operation circuit, such as a CPU (Central Processing Unit) or a FPGA (Field Programmable Gate Array), for example, and transfers instructions and data for the parts constituting the station ground apparatus 50*b*, on the basis of a program and data stored in the ground storage unit 54 and of the data and the like received from the on-board apparatus 20 (train 2) or another ground apparatus 50, thus integrally controlling the operations of the station ground apparatus 50*b*. The ground control unit 52 includes a transmission timing define unit 521, a polling communication control unit 522, a fixed position stop determination unit 523, a ground side relay processing unit 524, and a train ID handover control unit 526. The function sections included in the ground control unit 52 may be achieved by individual operation circuits, or achieved individually by an operation circuit through software operation processes.

At each of time points when the train list is updated, when the relay target train 2 is detected, and when the relay target train 2 departs the impending arrival range, the transmission timing define unit 521 refers to FIG. 8 and performs the above-referenced transmission timing defining process, and defines the transmission timing of the ground information for each management target train 2 set in a train list 543, in units of time slots. Here, the relay frequency is applied to the relay target train 2 whose train ID is set in the relay target train ID 547, while the normal frequency is applied to the other trains 2.

The polling communication control unit 522 performs polling communication with each management target train 2 according to the transmission timing defined by the transmission timing defining process, and detects the presences of the trains 2 in the corresponding control section 10. For the polling communication, the polling communication control unit 522 sets the synchronized opening and closing control instruction information received from the platform screen door control apparatus 60, in the ground information where the train ID of the relay target train 2 is the destination train ID.

The fixed position stop determination unit 523 performs the stop determination on the basis of the train location information and the train speed information obtained from the relay target train 2 through polling communication. Then, the determination result is set in the train fixed position flag 546 to update the flag, and is notified to the platform screen door control apparatus 60.

The ground side relay processing unit 524 detects the relay target train 2 reaching the impending arrival range, on the basis of the train location information obtained from the management target train 2 through polling communication. When the relay target train 2 is detected, a train reaching notification is transmitted to the platform screen door control apparatus 60 to start the reception control of the synchronized opening and closing control instruction information. The train state information obtained from the relay target train 2 through polling communication is transferred every time, together with the transmission source train ID, to the platform screen door control apparatus 60. On the other hand, when the relay target train 2 travels outside of the impending arrival range, the ground side relay processing unit 524 transmits a train departure notification to the platform screen door control apparatus 60, and finishes the reception control of the synchronized opening and closing control instruction information. At a time point when the relay target train 2 starts to move and departs the station, the train departure notification may be transmitted to the platform screen door control apparatus 60, and the reception control of the synchronized opening and closing control instruction information may be finished.

The train ID handover control unit 526 exchanges information including the train IDs pertaining to the trains 2 traveling and approaching, with the ground apparatus 50 in the control section 10 adjacent to the control section 10 controlled by the own apparatus (station ground apparatus 50*b*), and performs the process of handover (roaming) the train ID with which the train list is to be updated.

The ground communication unit 53 is a wired or wireless communication device achieved by a wireless communication module, a router, a modem, a TA, a jack of a communication cable for wired use, a control circuit, etc., and communicates with an external apparatus (in this embodiment, another ground apparatus 50 and the platform screen door control apparatus 60).

The ground storage unit 54 is achieved by a storage medium, such as an IC memory, a hard disk, or an optical disk. The ground storage unit 54 stores a program causing the station ground apparatus 50*b* to operate and for achieving various functions the station ground apparatus 50*b* has, data to be used during execution of the program, and the like. In this embodiment, the ground storage unit 54 stores a ground program 541, an own apparatus ID 542, train list data (train list) 543, management target train traveling information 544, transmission timing information 545, a train fixed position flag 546, and a relay target train ID 547.

The ground control unit 52 reads the ground program 541 from the ground storage unit 54 and executes the program, thereby achieving the transmission timing define unit 521, the polling communication control unit 522, the fixed position stop determination unit 523, the ground side relay processing unit 524, the train ID handover control unit 526 and the like. In the own apparatus ID 542, the ground apparatus ID of the own apparatus is set. In the train list 543, the train ID of the management target train 2 is set.

Figure 10:
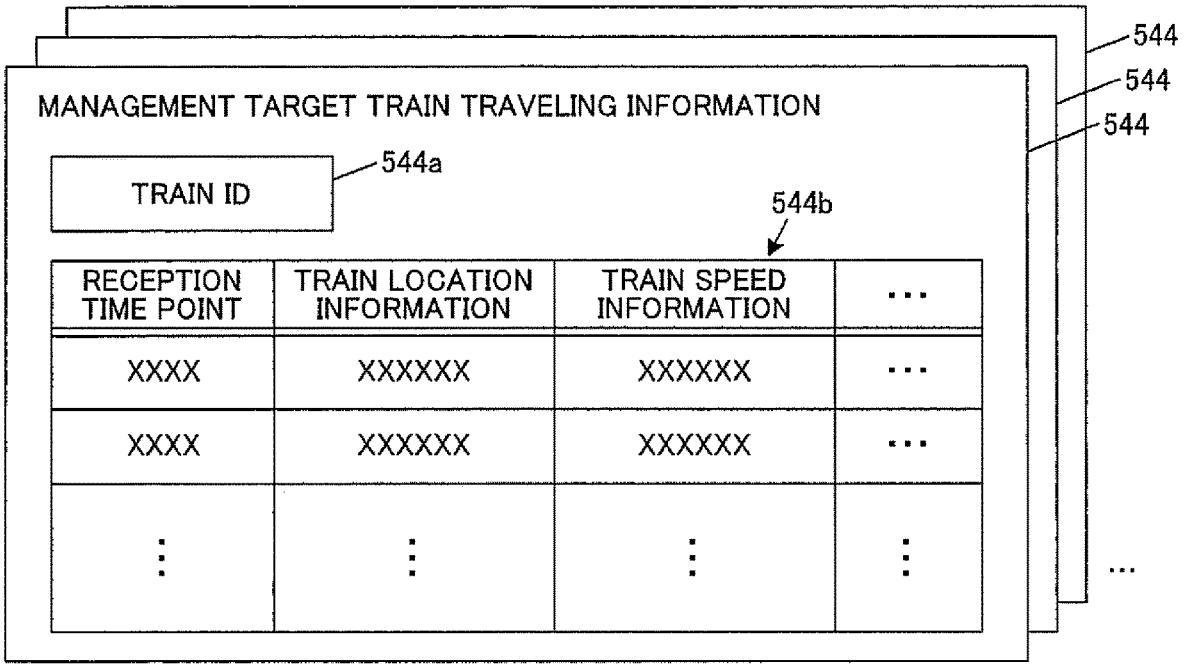
FIG. 10 is a diagram illustrating a data configuration example of management target train traveling information.

The management target train traveling information 544 stores the position and speed of the management target train 2 that are grasped as a result of polling communication. FIG. 10 is a diagram illustrating a data configuration example of the management target train traveling information 544. As illustrated in FIG. 10, the management target train traveling information 544 is prepared for each train ID 544*a* of the management target train 2, and is set as a reception history 544*b* of the train location information and the train speed information obtained from the train 2 concerned at the last polling communication or therebefore. Note that if transmission data other than the train location information is obtained from the on-board apparatus 20, the data is also included and stored in the reception history 544*b*.

Returning to FIG. 9, the transmission timing information 545 stores the transmission timing defined by the transmission timing defining process, in association with the destination train ID. The train fixed position flag 546 is flag information where a determination result of whether the train is stopped at the fixed position or not is set, the determination having been made by the fixed position stop determination unit 523.

In the relay target train ID 547, the train ID of the relay target train 2 traveling in the impending arrival range is set. When the relay target train 2 is detected, the ground side relay processing unit 524 adds the train ID to the relay target train ID 547. When the relay target train 2 travels outside of the impending arrival range, this processing unit removes the train ID from the relay target train ID 547.

2. On-Board Apparatus

Figure 11:
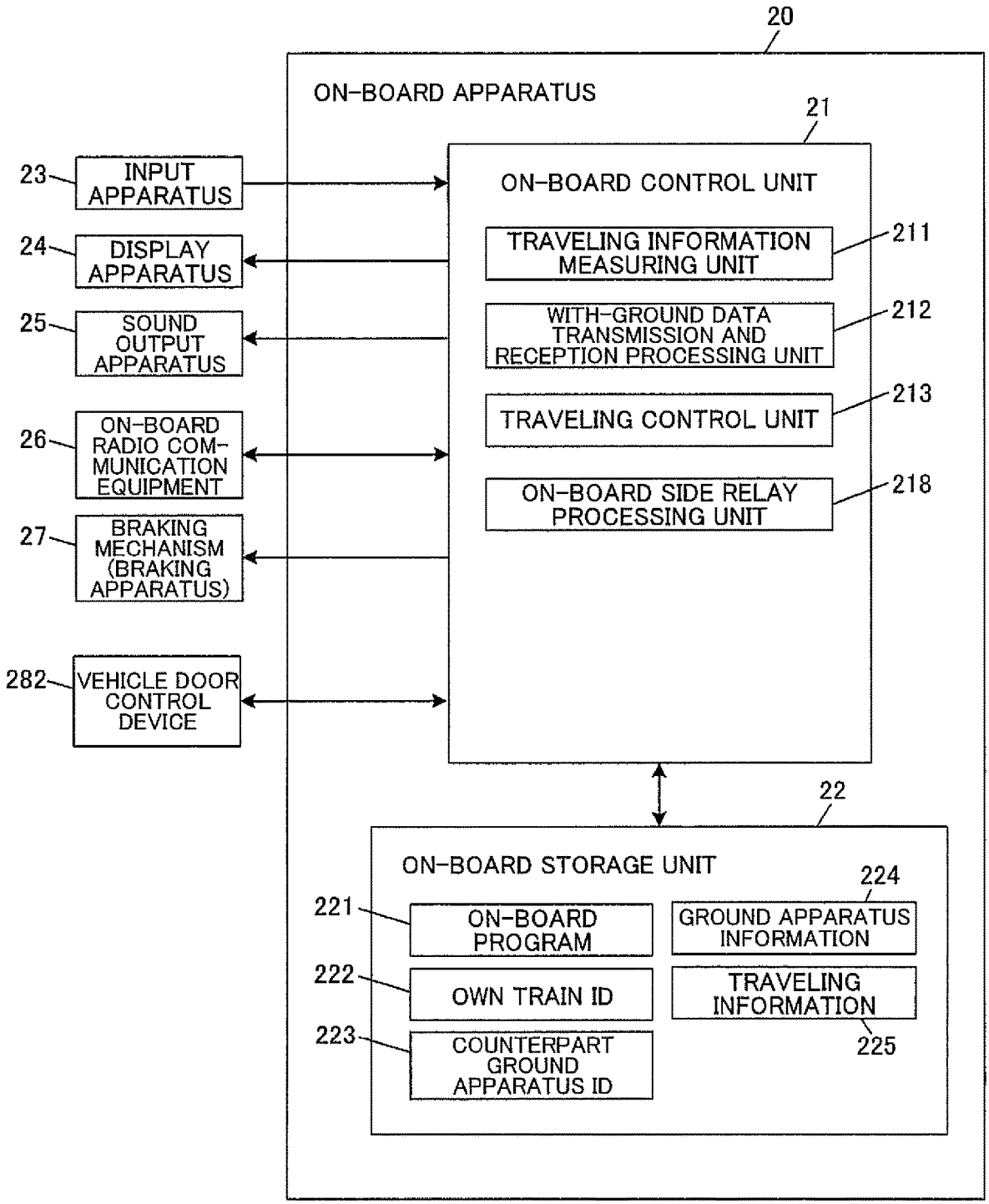
FIG. 11 is a block diagram illustrating a function configuration example of an on-board apparatus.

FIG. 11 is a block diagram illustrating a function configuration example of the on-board apparatus 20. As illustrated in FIG. 11, the on-board apparatus 20 is a type of a computer control apparatus that includes an on-board control unit 21 and an on-board storage unit 22, and is connected to an input apparatus 23, a display apparatus 24, an sound output apparatus 25, an on-board radio communication equipment 26, a braking mechanism (braking apparatus) 27, the train door control device 282 and the like. It is a matter of course that the encompassing range of the on-board apparatus 20 may be enlarged, and may include the input apparatus 23, the display apparatus 24, the sound output apparatus 25, the on-board radio communication equipment 26, and the train door control device 282.

The on-board control unit 21 includes, for example, an operation device, such as CPU or FPGA, and transfers instructions and data to the parts constituting the on-board apparatus 20 on the basis of the program and data that are stored in the on-board storage unit 22 and of the data received from the ground apparatus 50, and the like, thus integrally controlling the operations of the on-board apparatus 20. The on-board control unit 21 includes a traveling information measuring unit 211, an with-ground data transmission and reception processing unit 212, a traveling control unit 213, and an on-board side relay processing unit 218. The function sections included in the on-board control unit 21 may be achieved by individual operation circuits, or achieved individually by an operation circuit through software operation processes.

The traveling information measuring unit 211 measures the position (the traveling distance represented as kilometrage) and the speed of the own train as required, using the number of revolutions of the axle counted by the tachometer. Alternatively, instead of the measured value of the tachometer, or in addition of the measured value of the tachometer, a measured value by a satellite positioning system, such as GPS (Global Positioning System) may be used to measure the position and speed of the own train.

The with-ground data transmission and reception processing unit 212 performs control of receiving, via the on-board radio communication equipment 26, the ground information that is ground information transmitted by the ground apparatus 50 through polling communication and has a destination train ID indicating the own train ID 222. Upon receipt, the processing unit performs control that generates reply information whose transmission source ground apparatus ID is the destination ground apparatus ID, and transmits the information via the on-board radio communication equipment 26. In this case, the processing unit refers to the ground apparatus type of the ground apparatus information 224. If the ground apparatus 50 indicated by the transmission source ground apparatus ID is the station ground apparatus 50*b*, the processing unit determines whether the position of the own train is in the impending arrival range or not. If the train is traveling in the impending arrival range, the processing unit sets the train state information received from the train door control device 282 to the ground information.

The traveling control unit 213 performs traveling control of the own train as required, using the coming-in allowable range included in the ground information received from the opposite ground apparatus 50 that is the communication opposite party of polling communication (the ground information whose transmission source ground apparatus ID is the counterpart ground apparatus ID 223). The traveling control itself can be achieved using a publicly known technique. For example, traveling of the own train is controlled according to a speed check pattern where the train stops at the stop position in conformity with the coming-in allowable range.

When the position of the own train reaches the impending arrival range, the on-board side relay processing unit 218 transmits the train reaching notification to the train door control device 282, and starts reception control of the train state information. Furthermore, the processing unit transfers the synchronized opening and closing control instruction information received from the station ground apparatus 50*b* through polling communication, together with the transmission source ground apparatus ID, to the train door control device 282, every time. On the other hand, when the own train travels outside of the impending arrival range, the on-board side relay processing unit 218 transmits the train departure notification to the train door control device 282, and finishes reception control of the train state information. At a time point when the own train starts to move and departs the station, the train departure notification may be transmitted to the train door control device 282, and the reception control of the train state information may be finished.

The on-board storage unit 22 is achieved by a storage medium, such as an IC memory, a hard disk, or an optical disk. The on-board storage unit 22 preliminarily stores, or temporarily stores, every time of processing, a program causing the on-board apparatus 20 to operate and for achieving various functions the on-board apparatus 20 has, data to be used during execution of the program, and the like. In this embodiment, the on-board storage unit 22 stores an on-board program 221, an own train ID 222, an counterpart ground apparatus ID 223, ground apparatus information 224, and traveling information 225.

The on-board control unit 21 reads the on-board program 221 from the on-board storage unit 22 and executes the program, thereby achieving functions of the traveling information measuring unit 211, the with-ground data transmission and reception processing unit 212, the traveling control unit 213, the on-board side relay processing unit 218 and the like. In the own train ID 222, the train ID of the own train is set.

In the counterpart ground apparatus ID 223, the ground apparatus ID of the opposite ground apparatus 50 that is the ground apparatus 50 controlling the control section 10 where the own train is positioned, is set. The counterpart ground apparatus ID 223 is rewritten every time the own train reaches the boundary position of the control section 10. The boundary position with the next control section 10, and the ground apparatus ID of the next station ground apparatus 50*b* that is to become newly the opposite ground apparatus 50 can be identified on the basis of the ground apparatus information 224.

The ground apparatus information 224 stores a list of the ground apparatuses 50 disposed along the track 1. FIG. 12 is a diagram illustrating a data configuration example of the ground apparatus information 224. As illustrated in FIG. 12, the ground apparatus information 224 includes the ground apparatus type of the ground apparatus 50 concerned, the impending arrival range, the range of the corresponding control section 10 (the boundary position with the adjacent control section 10), and a tracking start position and a tracking end position of the ground apparatus 50 concerned (the range of the radio communication control region 70), which are set in association with the ground apparatus ID. The ground apparatus type is for discriminating the station ground apparatus 50*b* from the other ground apparatuses 50*a*. In a case where the ground apparatus 50 concerned is the station ground apparatus 50*b*, the corresponding impending arrival range is set. The ground apparatus type and the impending arrival range are not set for the ground apparatuses 50*a* other than the station ground apparatus 50*b*.

The traveling information 225 includes the position and speed of the own train, and is replaced, as required, with the latest position and speed measured by the traveling information measuring unit 211 as required.

Flows of Processes

Hereinafter, the flows of processes of the station ground apparatus 50*b* and the on-board apparatus 20 in this embodiment are described. Note that the ground control unit 52 in the station ground apparatus 50*b* reads the ground program 541 from the ground storage unit 54 and executes the program while the on-board control unit 21 in the on-board apparatus 20 reads the on-board program 221 from the on-board storage unit 22 and executes the program, thereby achieving the processes described below.

Figure 13:
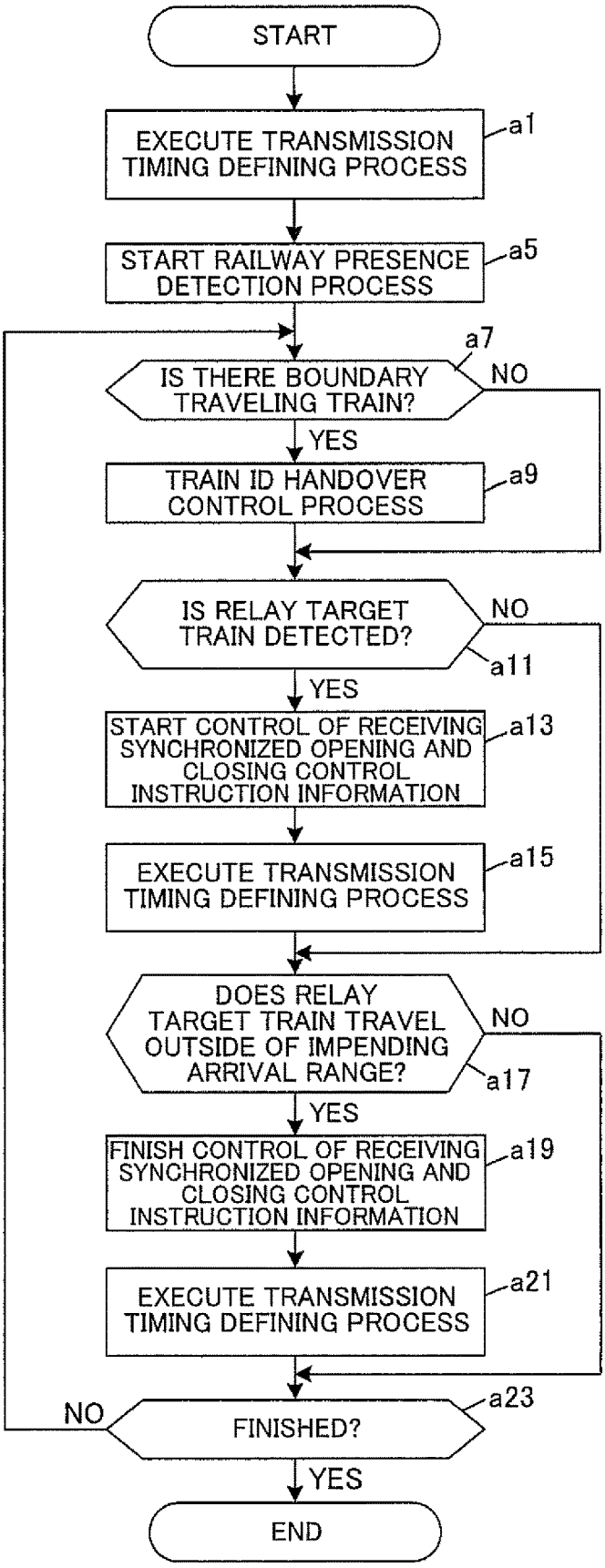
FIG. 13 is a flowchart illustrating a flow of an entire process of the station ground apparatus.

First, the flow of an overall process performed by the station ground apparatus 50*b* is described with reference to FIG. 13. As illustrated in FIG. 13, first, in the station ground apparatus 50*b*, the transmission timing define unit 521 executes the transmission timing defining process to generate the transmission timing information 545 (step a1).

Subsequently, a railway presence detection process is started (step a5). In the railway presence detection process, the polling communication control unit 522 starts the polling communication process.

Figure 14:
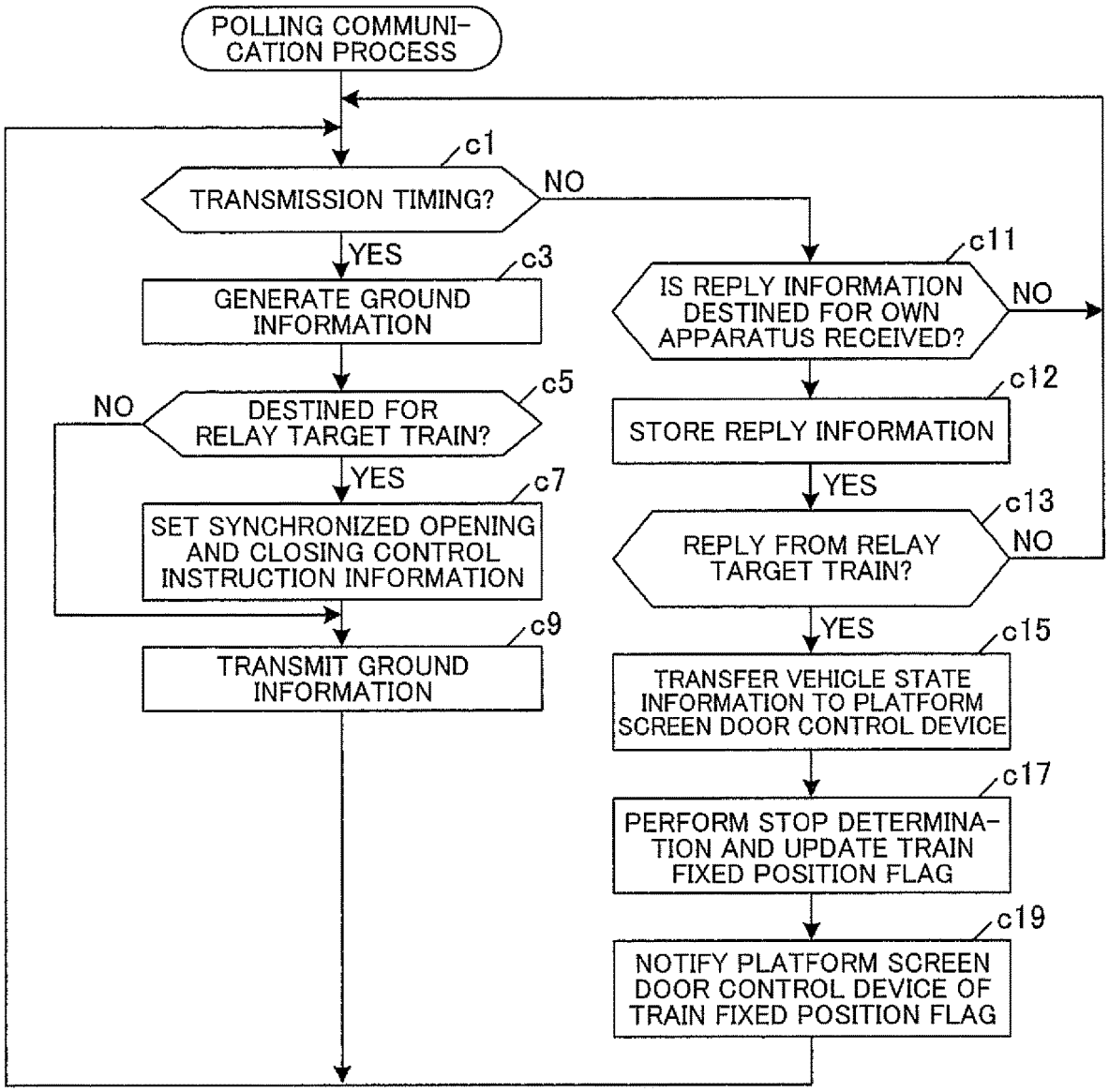
FIG. 14 is a flowchart illustrating a flow of a polling communication process.

FIG. 14 is a flowchart illustrating the flow of the polling communication process. As illustrated in FIG. 14, in the polling communication process, the polling communication control unit 522 performs the processes in steps c3 to c9 every time of the transmission timing (step c1: YES) set in the transmission timing information 545. That is, the polling communication control unit 522 generates the ground information to be transmitted to the train 2 concerned, using the destination train ID at the transmission timing this time, with the own apparatus ID 542 being adopted as the transmission source ground apparatus ID (step c3). The ground information may include information on the coming-in allowable range of the train 2 concerned.

In a case where the destination train ID is set in the relay target train ID 547 and indicates the relay target train 2 (step c5: YES), the polling communication control unit 522 sets, in the ground information, the latest synchronized opening and closing control instruction information received from the platform screen door control apparatus 60 by the reception control started in step a13 in FIG. 13 (step c7). Subsequently, the polling communication control unit 522 transmits the ground information via the radio base station 51, thereby making an inquiry the train 2 having the processing target ID (step c9).

Figure 16:
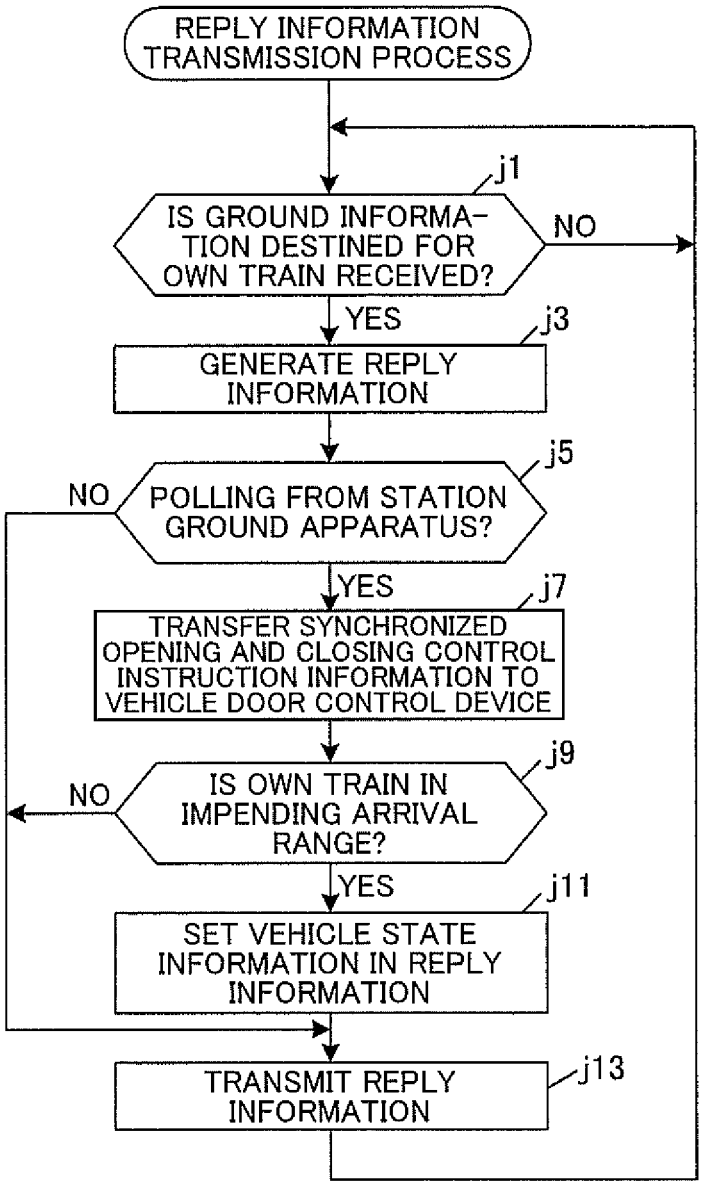
FIG. 16 is a flowchart illustrating a flow of a reply information transmission process.

The polling communication control unit 522 responds to the inquiry in step c9, and performs control of receiving the reply information destined for the own apparatus transmitted by the on-board apparatus 20 in step j13 in FIG. 16. The train location information included in the reply information is added to the reception history 544*b* in the management target train traveling information 544 concerned, on the basis of the transmission source train ID. Here, in a case where the train 2 indicated by the transmission source train ID is the relay target train 2, the reply information includes the train state information. Accordingly, when the reply information is received (step c11: YES), the reply information is stored (step c12). Subsequently, if the reply is from the relay target train 2 (step c13: YES), the ground side relay processing unit 524 transfers the train state information together with the transmission source train ID, to the platform screen door control apparatus 60 (step c15). The fixed position stop determination unit 523 performs the stop determination on the basis of the train location information and the train speed information, and sets the determination result to update the train fixed position flag 546 (step c17). The fixed position stop determination unit 523 then notifies the platform screen door control apparatus 60 of the updated train fixed position flag 546 (step c19). According to the process here, when the relay target train 2 reaches the station and stops at the fixed position, this fact (train fixed position flag 546=ON) is notified to the platform screen door control apparatus 60.

Returning to FIG. 13. When the railway presence detection process is started, the train ID handover control unit 526 monitors the position of each management target train 2. If there is the train 2 reaching the boundary position with the corresponding control section 10 of the ground apparatus 50 adjacent in the traveling direction, the control unit detects the train 2 as a boundary traveling train 2 (step a7: YES) and performs a train ID handover control process with the ground apparatus 50 adjacent in the traveling direction (step a9). On the contrary, it is assumed that the boundary traveling train 2 reaching the boundary position with the corresponding control section 10 of the ground apparatus 50 adjacent in the incoming direction, and if there is a notification issued by the ground apparatus 50 in the incoming direction, the control unit performs the train ID handover control process with this ground apparatus 50 (step a9).

The ground side relay processing unit 524 also monitors the position of each management target train 2. Upon detection of the train (relay target train) 2 reaching the impending arrival range (step a11: YES), the processing unit transmits the train reaching notification to the platform screen door control apparatus 60, and starts reception control of the synchronized opening and closing control instruction information (step a13). The transmission timing define unit 521 executes the transmission timing defining process to update the transmission timing information 545 (step a15). According to the process here, the communication frequency of polling communication with the relay target train 2 reaching the impending arrival range is switched from the normal frequency to the relay frequency.

On the other hand, when the relay target train 2 travels outside of the impending arrival range (step a17: YES), the ground side relay processing unit 524 transmits the train departure notification to the platform screen door control apparatus 60, and finishes the reception control of the synchronized opening and closing control instruction information (step a19). The transmission timing define unit 521 executes the transmission timing defining process to update the transmission timing information 545 (step a21). According to the process here, the communication frequency with the train 2 traveling outside of the impending arrival range is returned from the relay frequency to the normal frequency.

Until this process is finished, or until shutting down of the apparatus, such as completion of the operations of all the trains on the current day (step a23: NO), the processing returns to step a7, and the above-referenced processes are repeated.

Figure 15:
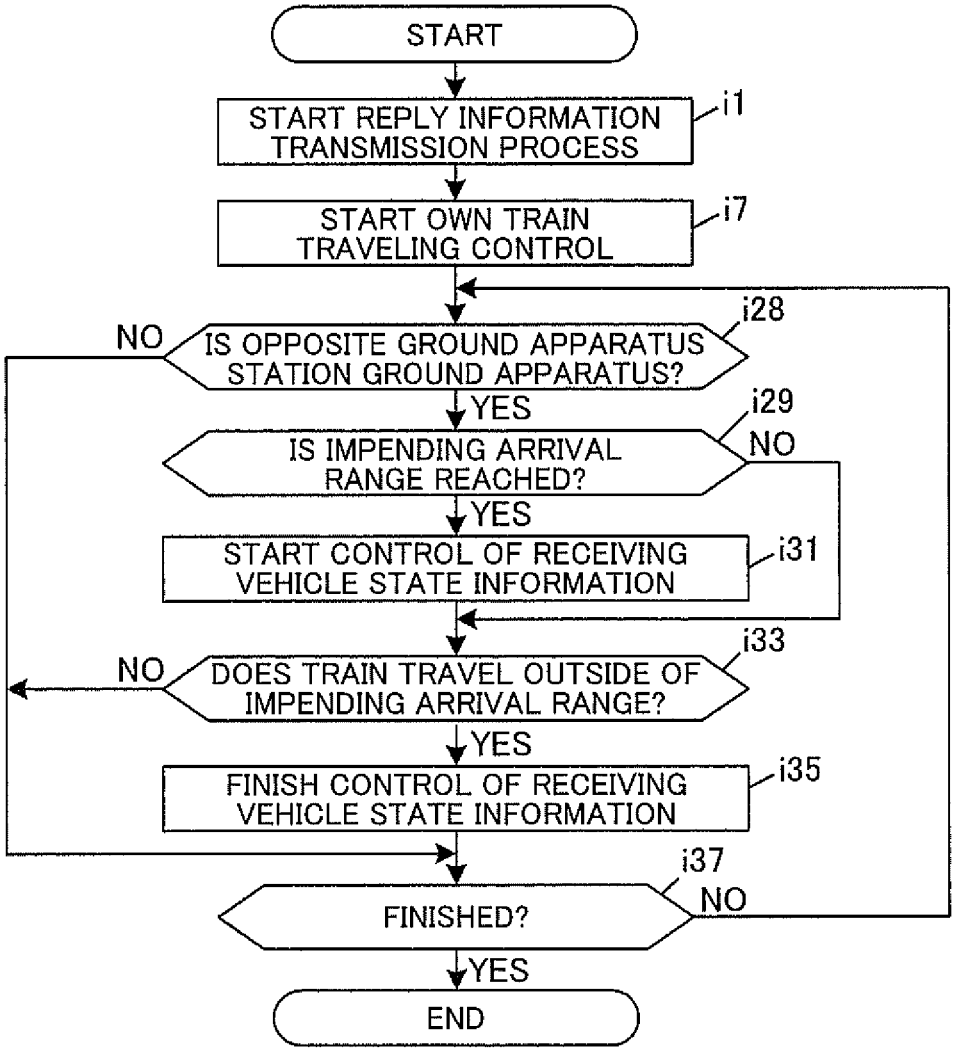
FIG. 15 is a flowchart illustrating a flow of an entire process of the on-board apparatus.

Next, the flow of an overall process performed by the on-board apparatus 20 is described with reference to FIG. 15. As illustrated in FIG. 15, in the on-board apparatus 20, first, the with-ground data transmission and reception processing unit 212 starts the reply information transmission process (step i1). The traveling control unit 213 then starts the traveling control of the own train (step i7).

During traveling, the opposite ground apparatus 50 serves as the station ground apparatus 50*b* (step i28: YES). When the own train reaches the impending arrival range (step i29: YES), the on-board side relay processing unit 218 transmits the train reaching notification to the train door control device 282, and starts reception control of the train state information (step i31). On the other hand, when the own train travels outside of the impending arrival range (step i33: YES), the on-board side relay processing unit 218 transmits the train departure notification to the train door control device 282, and finishes reception control of the train state information (step i35).

Until this process is finished, or until shutting down of the apparatus due to completion of the operations of the own train (step i37: NO), the traveling control is continuously performed, and the processes in steps i28 to i35 are repeated.

FIG. 16 is a flowchart illustrating a flow of the reply information transmission process. The processes in FIG. 16 are repeated every time of reception of the ground information transmitted by the ground apparatus 50 in step c9 in FIG. 14. That is, first, the with-ground data transmission and reception processing unit 212 performs control of receiving the ground information destined for the own train from the ground apparatus 50. When polling communication by the ground apparatus 50 is performed and the ground information destined for the own train is received (step j1: YES), the with-ground data transmission and reception processing unit 212 adopts the transmission source ground apparatus ID in the received ground information as the destination ground apparatus ID and adopts the own train ID 222 as the transmission source train ID, reads the position of the own train from the traveling information 225 and adopts the position as the train location information, and generates the reply information (step j3).

If the polling received in step j1 is polling from the station ground apparatus 50*b* (step j5: YES), the on-board side relay processing unit 218 transfers the synchronized opening and closing control instruction information together with the transmission source ground apparatus ID to the train door control device 282 (step j7). If the own train is in the impending arrival range (step j9: YES), the with-ground data transmission and reception processing unit 212 sets, in the reply information, the latest train state information received from the train door control device 282 through the reception control started in step i31 in FIG. 15 (step j11). The with-ground data transmission and reception processing unit 212 then transmits the reply information through the on-board radio communication equipment 26 (step j13).

As described above, according to this embodiment, the ground apparatus 50 is configured so as to perform the polling communication with the train 2 in order, at least, to grasp the position of the train 2 and be capable of communicating with the platform screen door control apparatus 60 of the platform screen doors installed on the station. The ground apparatus 50 can relay transmission and reception of the data (data for door control) required to open and close the platform screen doors and the train doors in synchronization, at a required communication frequency. That is, during the polling communication with the train 2, the ground apparatus 50 can transmit, to the train, the synchronized opening and closing control instruction information received from the platform screen door control apparatus 60. Meanwhile, the apparatus can obtain the train state information together with the train information during reply from the train 2 in response to the polling, and transmit the obtained train state information to the platform screen door control apparatus 60.

In this case, when the train 2 reaches the predetermined impending arrival range around the stop position at the station, the communication frequency of the polling communication can be switched to a second communication frequency higher than the previous first communication frequency. The communication frequency means the number of communications in a constant time. The higher the frequency is, the larger the number of communications in the constant time is, and the communication interval decreases accordingly. It can be determined whether the impending arrival range is reached or not on the basis of the train location information obtained through the previous polling communication. Accordingly, in the train 2, opening and closing of the train doors can be controlled using the synchronized opening and closing control instruction information from the platform screen door control apparatus 60. In the platform screen door control apparatus 60, opening and closing of the platform screen doors can be controlled using the train state information from the train 2. Consequently, opening and closing control of the platform screen doors and the train doors in synchronization can be achieved without any need of a dedicated communication unit for transmitting and receiving the data for door control. Furthermore, since reaching the impending arrival range makes the communication frequency highly frequent, opening and closing the platform screen doors and the train doors in synchronization can be achieved with good responsiveness in a short time period.

The example of the embodiment to which the invention is applied has thus been described. However, embodiments to which the invention is applicable are not limited to the above-referenced embodiment.

Although only some embodiments of the present invention have been described in detail above, those skilled in the art will readily appreciate that many modifications are possible in the embodiments without materially departing from the novel teachings and advantages of this invention. Accordingly, all such modifications are intended to be included within scope of this invention.

What is claimed is:

1. A ground apparatus of a ground apparatus system, the ground apparatus being configured to be capable of communicating with a platform screen door control device for a platform screen door installed at a station where the train stops and performing radio communication with a train, the radio communication being polling communication in which the ground apparatus serves as a primary station, and the train serves as a secondary station, the train being configured to reply with reply information including train location information, and train state information to be used in cases where the platform screen door is opened and closed in synchronization with at least one train door, when polling from the ground apparatus is received, the reply information serving as a reply to the polling, the ground apparatus, comprising:

a radio communication control unit that performs the polling communication at a given communication frequency, and obtains the reply information from the train;

a communication frequency control unit that sets the communication frequency to a first communication frequency, uses the train location information obtained from the train through the polling communication to determine whether the train reaches a predetermined impending arrival range including a stop position at the station or not, and switches the communication frequency to a second communication frequency higher than the first communication frequency when the train reaches the impending arrival range; and a door-synchronized opening and closing time relay that communicates with the platform screen door control device at times of door opening and closing in synchronization, transmits, to the train through the polling communication, given synchronized opening and closing control instruction information received from the platform screen door control device, and transmits the train state information obtained from the train in response to the transmitted given synchronized opening and closing control instruction information through the polling communication, to the platform screen door control device.

2. The ground apparatus according to claim 1, further comprising a stop position determination and notification unit that uses the train location information obtained from the train through the polling communication to determine whether the train is positioned at the stop position at the station or not, and notifies the platform screen door control device of a determination result thereof.

3. The ground apparatus according to claim 1, wherein the communication frequency control unit further executes switching the communication frequency from the second communication frequency to the first communication frequency in response to departure of the train from the station.

4. The ground apparatus according to claim 2, wherein the communication frequency control unit further executes switching the communication frequency from the second communication frequency to the first communication frequency in response to departure of the train from the station.

5. The ground apparatus according to claim 1, wherein the communication frequency control unit further executes switching the communication frequency from the second communication frequency to the first communication frequency in response to the train's traveling outside of the impending arrival range.

6. The ground apparatus according to claim 2, wherein the communication frequency control unit further executes switching the communication frequency from the second communication frequency to the first communication frequency in response to the train's traveling outside of the impending arrival range.

7. The ground apparatus according to claim 1, further comprising a storage unit that stores a train list that is a list of train identification information on management target trains allowing the ground apparatus to communicate therewith through the radio communication, wherein the radio communication control unit performs the polling communication with each train included in the train list, and the communication frequency control unit controls changing of the communication frequency of the polling communication, for each train included in the train list.

8. The ground apparatus according to claim 2, further comprising a storage unit that stores a train list that is a list of train identification information on management target trains allowing the ground apparatus to communicate therewith through the radio communication, wherein the radio communication control unit performs the polling communication with each train included in the train list, and the communication frequency control unit controls changing of the communication frequency of the polling communication, for each train included in the train list.

9. The ground apparatus according to claim 3, further comprising a storage unit that stores a train list that is a list of train identification information on management target trains allowing the ground apparatus to communicate therewith through the radio communication, wherein the radio communication control unit performs the polling communication with each train included in the train list, and the communication frequency control unit controls changing of the communication frequency of the polling communication, for each train included in the train list.

10. The ground apparatus according to claim 5, further comprising a storage unit that stores a train list that is a list of train identification information on management target trains allowing the ground apparatus to communicate therewith through the radio communication, wherein the radio communication control unit performs the polling communication with each train included in the train list, and the communication frequency control unit controls changing of the communication frequency of the polling communication, for each train included in the train list.

11. A ground apparatus system, comprising:

a plurality of ground apparatuses provided along a predetermined railway route to perform radio communication with a train, the plurality of ground apparatuses being disposed so that radio communication control regions of adjacent ground apparatuses partially overlap each other in order to prevent occurrence of a communication blank zone of the radio communication; and a platform screen door control device for a platform screen door installed at a station where the train stops; and an on-board apparatus arranged on the train that communicates with the plurality of ground apparatuses through radio communication during operation of the train on the predetermined railway route, wherein at least one ground apparatus of the plurality of ground apparatuses is configured to be capable of communicating with the platform screen door control device, the radio communication is polling communication in which the at least one ground apparatus serves as a primary station, and the on-board apparatus serves as a secondary station, the on-board apparatus is configured to reply with reply information including train location information, and train state information to be used in cases where the platform screen door is opened and closed in synchronization with a train door, when polling from the at least one ground apparatus is received, the reply information serving as a reply to the polling, and the at least one ground apparatus comprises:

a radio communication control unit that performs the polling communication at a given communication frequency, and obtains the reply information from the on-board apparatus;

a communication frequency control unit that sets the communication frequency to a first communication frequency, uses the train location information obtained from the on-board apparatus through the polling communication to determine whether the train reaches a predetermined impending arrival range including a stop position at the station or not, and switches the communication frequency to a second communication frequency higher than the first communication frequency when the train reaches the impending arrival range; and a door-synchronized opening and closing time relay that communicates with the platform screen door control device at times of door opening and closing in synchronization, transmits, to the train through the polling communication, given synchronized opening and closing control instruction information received from the platform screen door control device, and transmits the train state information obtained from the train in response to the transmitted given synchronized opening and closing control instruction information through the polling communication, to the platform screen door control device.

* * * * *